US005863220A

United States Patent [19]

Holliday

[11] Patent Number: 5,863,220

[45] Date of Patent: Jan. 26, 1999

[54] END CONNECTOR FITTING WITH CRIMPING DEVICE

[76] Inventor: Randall A. Holliday, 10045 Mead Ct., Westminster, Colo. 80030

[21] Appl. No.: 747,539

[22] Filed: Nov. 12, 1996

[51] Int. Cl.[6] ..... H01R 17/04

[52] U.S. Cl. ..... 439/584; 439/462

[58] Field of Search ..... 439/584, 578, 439/583, 585, 320, 321, 461, 462

[56] References Cited

U.S. PATENT DOCUMENTS

| | | | |
|---|---|---|---|
| 3,184,706 | 5/1965 | Atkins | 439/584 |
| 4,145,075 | 3/1979 | Holzmann | 439/461 |
| 4,358,079 | 11/1982 | Navarro | 439/461 |
| 4,655,159 | 4/1987 | McMills | 439/584 |
| 4,944,686 | 7/1990 | Gertz | 439/462 |
| 5,392,508 | 2/1995 | Holliday et al. | 29/751 |
| 5,564,942 | 10/1996 | Lee | 439/462 |
| 5,586,910 | 12/1996 | Del Negro et al. | 439/584 |

FOREIGN PATENT DOCUMENTS

| | | | |
|---|---|---|---|
| 3211008 | 10/1983 | Germany | 439/578 |
| 2249433 | 5/1992 | United Kingdom | 439/578 |
| 2277207 | 10/1994 | United Kingdom | 439/578 |

*Primary Examiner*—Paula Bradley
*Assistant Examiner*—Tho D. Ta
*Attorney, Agent, or Firm*—John E. Reilly

[57] ABSTRACT

An end connector fitting for splicing electrically conductive members, such as, coaxial cables together includes splicing devices which are threaded onto opposite ends of the fitting to cause deformable sleeve portions at opposite ends of the fitting to be crimped into sealed engagement with each electrically conductive member, and the splicing devices can be left in place after the crimping operation. The splicing devices may be formed with unitary tapered surface portions or separate tubular inserts with tapered surface portions to impart the necessary crimping force to the sleeve portions. In an alternate form, the fitting may be provided with a single splicing device at one end to crimp the sleeve portion into sealed engagement with an electrically conductive member and the opposite end being adapted for connection to a post or terminal.

19 Claims, 3 Drawing Sheets

END CONNECTOR FITTING WITH CRIMPING DEVICE

BACKGROUND AND FIELD OF INVENTION

This invention relates to fittings for splicing cables together or for securing a cable to another member; and more particularly relates to a novel and improved fitting for mechanically and electrically connecting a coaxial cable to another electrically conductive member, such as, another coaxial cable or to a terminal or post by means of a crimping device carried on the fitting.

I have previously devised an end connector which is capable of effecting sealed engagement with one end of a coaxial cable and which is characterized by having a generally cylindrical crimping surface or sleeve for ease of engagement by a crimping tool which will uniformly reduce the diameter of the sleeve into a generally conical configuration snugly engaging the end of the cable, reference being made to U.S. Pat. No. 5,392,508 and Ser. No. 378,971.

Crimping tools of the type disclosed in the hereinabove referenced patent and patent application are primarily intended for use by professional cable installers. However, there are many situations in which it is not economically feasible to purchase a crimping tool or where a crimping tool is not available either to splice ends of coaxial cables together or to connect one end of a coaxial cable to a fitting. Accordingly, there is a need in many applications for a connector end fitting which incorporates its own crimping device to achieve the necessary sealed engagement between the end connector and coaxial cable or other electrically conductive member.

SUMMARY OF THE INVENTION

It is therefore an object of the present invention to provide for a novel and improved connector end fitting with its own self-contained crimping device.

It is another object of the present invention to provide for a novel and improved connector end fitting with crimping device which is low-cost and easy to assemble for use in crimping an end connector onto an end of the cable.

It is a further object of the present invention to provide for a novel and improved combination connector end crimping device in which the crimping device can remain on the end connector to support the crimped or radially deformable portion of the connector once the crimping operation is completed.

It is a still further object of the present invention to provide for a novel and improved crimping device which can be employed singly or in pairs in association with an end connector to cause inward radial deformation of a sleeve or sleeves on the connector into snug engagement with a cable end or ends; and further wherein the crimping device(s) can effect the necessary crimping engagement with the end connector with the use of a conventional wrench or other tool.

In accordance with the present invention, there has been devised an end connector fitting for connecting a cable of the type having an electrically conductive member to another electrically conductive member and wherein the fitting comprises a sleeve portion which is sized for insertion of an end of the cable therethrough, and a crimping member having an inner tapered surface portion and means for advancing the crimping member axially with respect to the sleeve portion whereby the tapered surface portion imparts inward radial deformation to the sleeve portion into crimping engagement with an external surface portion of the cable. Preferably, the sleeve portion is cylindrical and the tapered surface portion is generally conical so that when brought into engagement with the sleeve portion will cause uniform inward radial deformation of the sleeve into a correspondingly conical configuration and in snug engagement with the end of the cable; and accordingly, the tapered surface portion on the crimping device has a first diameter at one end which substantially corresponds to the outer diameter of the sleeve member and a second diameter axially spaced from the first diameter which substantially corresponds to an outer diameter of the cable. Still further, the crimping member is preferably in the form of a nut with the advancing means being internally threaded on the nut and engageable with a complementary threaded portion on the end connector so that threaded advancement of the nut with respect to the complementary threaded portion will cause axial advancement of the tapered surface portion along the sleeve and radially contract the sleeve into sealed engagement with the cable. In this relation, the tapered surface portion either may be formed as a unitary part of the crimping member or as a separate tubular insert having an inner tapered or generally conical surface and which is loosely inserted into the crimping member behind the internally threaded portion and axially advanced along the sleeve portion in response to threaded advancement of the nut to cause inward radial deformation of the sleeve into snug engagement with the end of the cable.

The crimping nut member as described either may remain intact on the end connector once the crimping operation is completed or may be removable from the end connector. Threaded connection of the nut to the end connector is particularly effective in creating the necessary axial force to advance the tapered surface portion along the sleeve and radially deform the sleeve inwardly into crimping engagement. Nevertheless, for non-circular sleeve members, such as, a hex-type sleeve, it will be appreciated that the tapered surface portion would be correspondingly non-circular and, rather than rotating with rotation of the threaded portion would be journaled with respect to the threaded portion so as to advance only in an axial direction along the sleeve.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENTS

Figure 1:
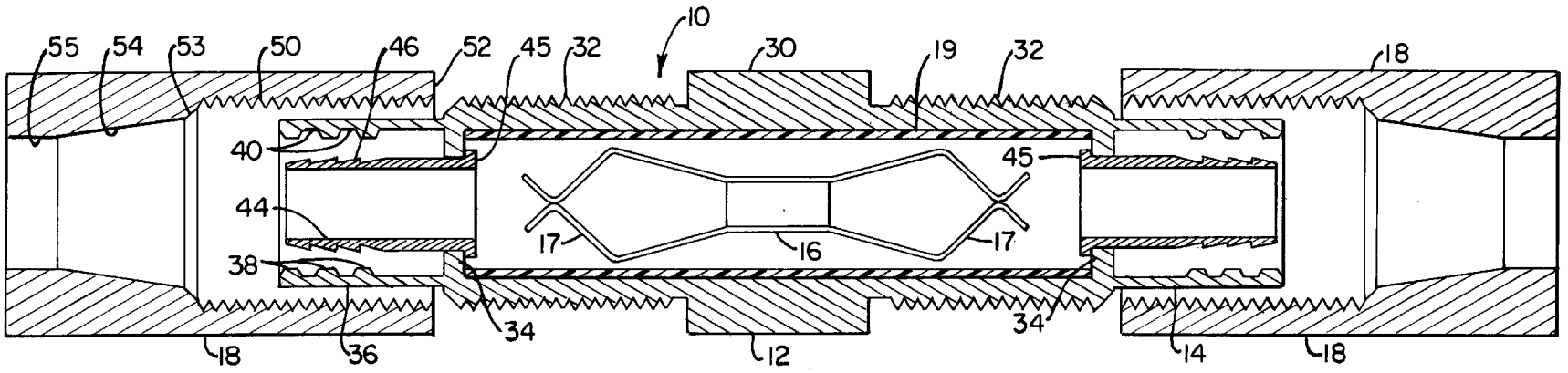
FIG. 1 is a cross-sectional view of a preferred form of splice-type end connector fitting with crimping devices at opposite ends thereof in accordance with the present invention.
Figure 2:
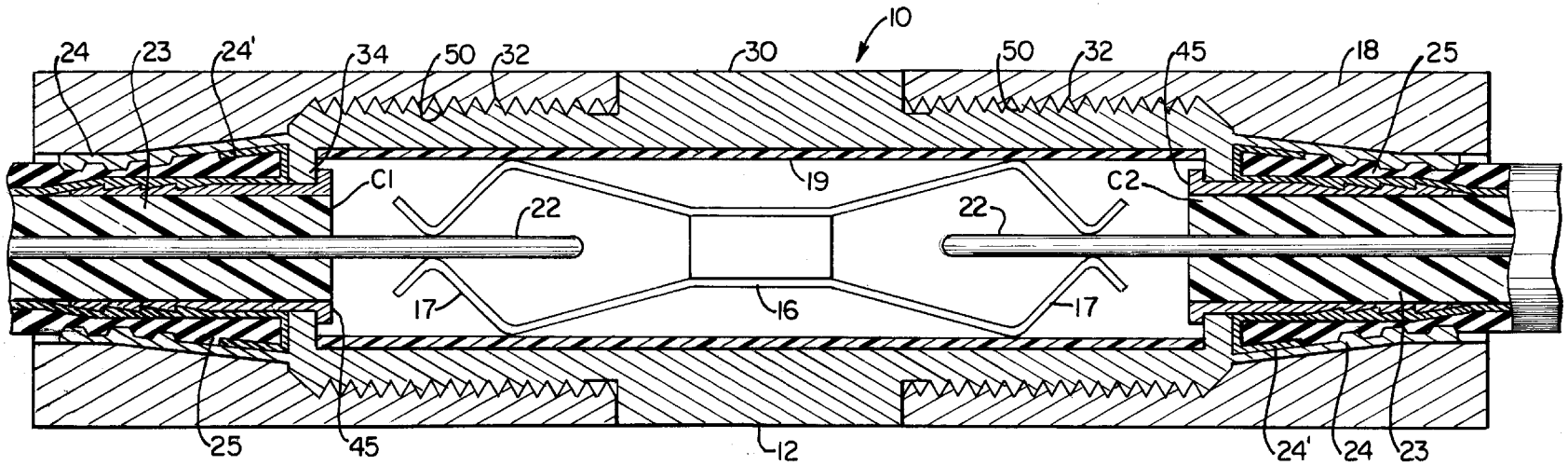
FIG. 2 is an enlarged view of the preferred form of invention illustrated in FIG. 1 illustrating spliced together coaxial cable ends.
Figure 3:
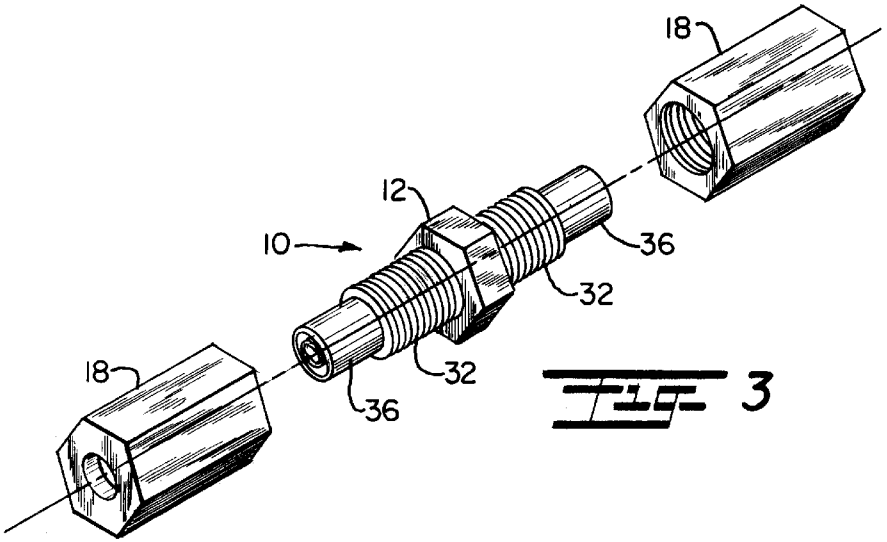
FIG. 3 is a somewhat perspective, exploded view of the fitting illustrated in FIGS. 1 and 2.

There is shown by way of illustrative example in FIGS. 1 to 3 a preferred form of end connector fitting 10 which is broadly comprised of opposite annular connecting ends 14 joined by a hollow cylindrical, relatively thick-walled elongated body 12, and a pair of splicing devices 18, there being one at each end of the fitting. In addition, a jack 16 having opposite pronged ends 17 is mounted within the hollow interior of the body 12 to establish electrical connection between electrical conductive members inserted through opposite ends of the fitting 10 in a manner to be described. An insulating liner 19 is inserted into the hollow interior of the body 12 in outer concentric relation to the jack 16. FIG. 1 shows the interrelationship between the parts prior to insertion of the electrical conductive members into the fitting, and FIG. 2 illustrates the relationship between parts upon insertion of the electrically conductive members as represented by coaxial cables C1 and C2 and tightening of the splicing devices 18 into threaded engagement with the body 12 to mechanically and electrically splice the ends of the cables C1 and C2 together.

As a setting for the present invention, the coaxial cables C1 and C2 are correspondingly comprised of an inner concentric conductor pin 22, a dielectric insulating layer 23 surrounding the pin 22, a braided conductor layer 24 surrounding the dielectric layer 23 and an outer dielectric jacket 25. Very often, it is necessary to splice together the ends of a pair of coaxial cables C1 and C2 in the field and, to this end, the conductor pins 22 are exposed by removing a limited length of the dielectric insulators 23, and a portion of the conductor 24 is peeled away from the insulator 23 and doubled over the jacket 25, as designated at 24' in FIG. 2.

Referring in more detail to the end connector fitting 10, the body 12 is of elongated tubular configuration having an intermediate shoulder portion 30 having external flats for engagement by a tool, the portion 30 being of increased thickness with respect to externally threaded portions 32 along the remaining length of the body on opposite sides of the shoulder portion 30. Radially inwardly directed annular flanges 34 are provided at opposite ends of the body 12. The connecting ends 14 form axial extensions of the body 12, each end 14 including an outer thin-walled sleeve portion 36 which, as best seen from FIG. 3, is of continuous cylindrical configuration uninterrupted by any axial separation or slots. The sleeve portion 36 has a smooth external surface and is provided with endless ribs 38 at uniform, axially spaced intervals along the interior of the sleeve so as to define grooves 40 therebetween, each of a width substantially equal to that of the ribs 38. Both the ribs 38 and grooves 40 are of substantially rounded cross-sectional configuration so that when crimped inwardly will cause the resilient material of the jacket 25 to fill the grooves 40 and effectively form O-rings between the jacket 25 and the rings 38. The rings 38 are formed along the crimping zone which is that length of the sleeve 36 adjacent to its open end opposite to the flange 34 and spaced from the flange a distance sufficient to avoid contact or engagement with the doubled over portion 24' of the conductor 24.

Each connecting end 14 includes a separate inner sleeve 44 having an external shoulder 45 at one end and a plurality of serrations 46 along the external surface of the inner sleeve 44 in facing relation to the rings 38, the serrations 46 being angled in a direction toward the end 45 which is inserted into the body 12, and the inner sleeve 44 is dimensioned such that its external surface will effect close-fitting engagement with the radially inner edge of the flange 34 on the body 12.

When each cable end C1 and C2 is prepared as described to expose its conductor pin 22, it is then inserted into one of the connecting ends 14 with the exposed conductor pin 22 and layer 23 extending through the inner sleeve 44. The braided conductor layer 24 and jacket 25 extend through the annular space 43 between the inner sleeve 44 and outer sleeve 36 until the doubled over end portion 24' abuts the flange 34 at the end of the body 12, and the conductor pin 22 will then project into the hollow interior of the body 12 and into engagement with the prongs 17 thereby forcing them apart as shown in FIG. 2.

An important feature of the present invention resides in the splicing devices 18 which are supplied as a part of each end connector fitting 10 instead of requiring a separate crimping tool, such as, the type disclosed in my hereinbefore referred to U.S. Pat. No. 5,392,508. In FIGS. 1 to 3, each splicing device 18 is in the form of a nut made up of a one-piece annular body having an internally threaded, relatively thin-walled portion 50 extending away from open end 52 for a length or distance corresponding to the length of the external threaded portion 32 on the body 12 and communicating with a chamfered portion 53 at the entrance to a tapered annular die surface 54 which terminates in a straight cylindrical die portion 55 at its leading or forward end. The nut body surrounding the tapered or conical die portion 54 as well as the reduced end portion 55 is thick-walled in relation to that surrounding the threaded portion 50, the total length of the die portions 54 and 55 corresponding to the length of the sleeve 36, and the length of the internally threaded portion 50 as well as the externally threaded portion 32 correspond to the total length of the die portions 54 and 55. The tapered die portion 54 has a diameter at its entrance corresponding to the external surface of the outer sleeve 36 and a diameter at its reduced end which merges into the die portion 55 approximating that of the inner diameter of the sleeve 36 along the crimping zone so that when the nut member 18 is threadedly advanced along the threaded portion 32 the tapered die portion 54 will impart a progressively increasing radially inward crimping force along the crimping zone thereby radially contracting the ribs 38 along the crimping zone into uniform sealing engagement with the jacket 25. The reduced diameter die section 55 will progressively crimp the sleeve 36 along a portion of the crimping zone into a generally cylindrical configuration as the nut moves into fully threaded engagement with the threaded portion 32 as illustrated in FIG. 2.

As shown in FIG. 3, the external surface of the shoulder portion 30 of the body 12 is of generally hexagonal configuration, and the external surfaces of the splicing devices 18 are similarly of hexagonal configuration to facilitate engagement by a conventional wrench in applying the necessary torque or rotational force to the splicing devices to effect the necessary inward radial deformation of the sleeves 36 by the respective splicing devices 18. For the same purpose, the connector end fitting is composed of a metal which is sufficiently malleable, particularly along the thin-walled sleeves 14, as to be capable of undergoing inward radial contraction or deformation in response to the axial movement of the tapered die portions 54 and 55 therealong, bearing in mind that the cross-sectional configuration of the die portions 54 and 55 is circular so as to achieve a uniform inward reduction in diameter of the outer sleeves 36 into a circular or conical configuration, as opposed to a non-circular configuration.

Figure 4:
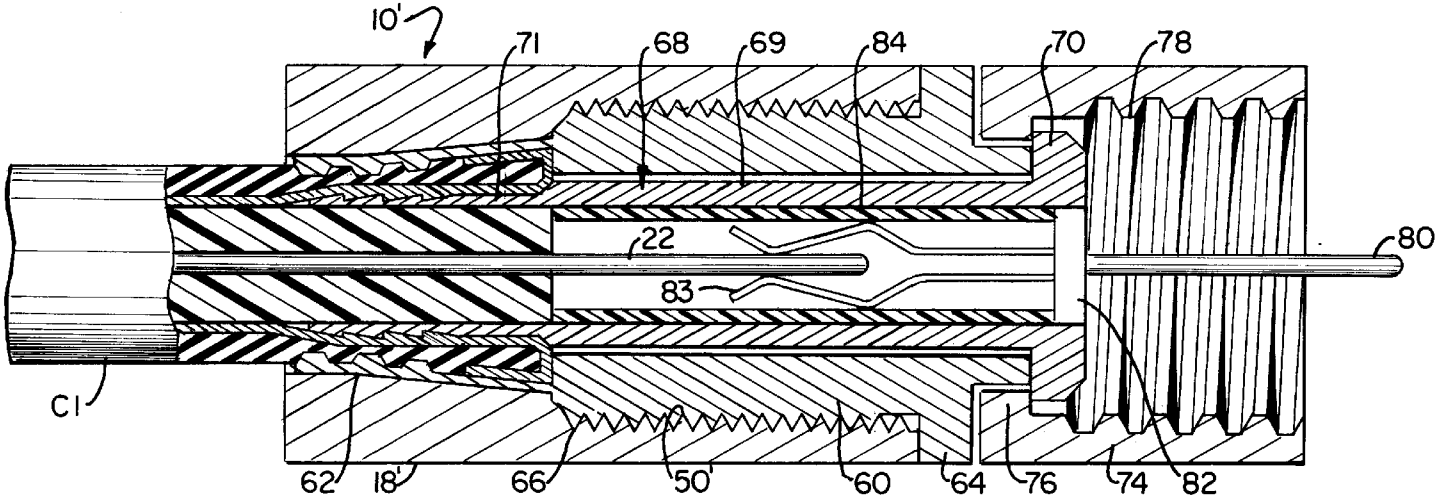
FIG. 4 is a cross-sectional view of a modified form of end connector fitting with crimping device for securing a coaxial cable to a post or terminal in accordance with the present invention.
Figure 5:
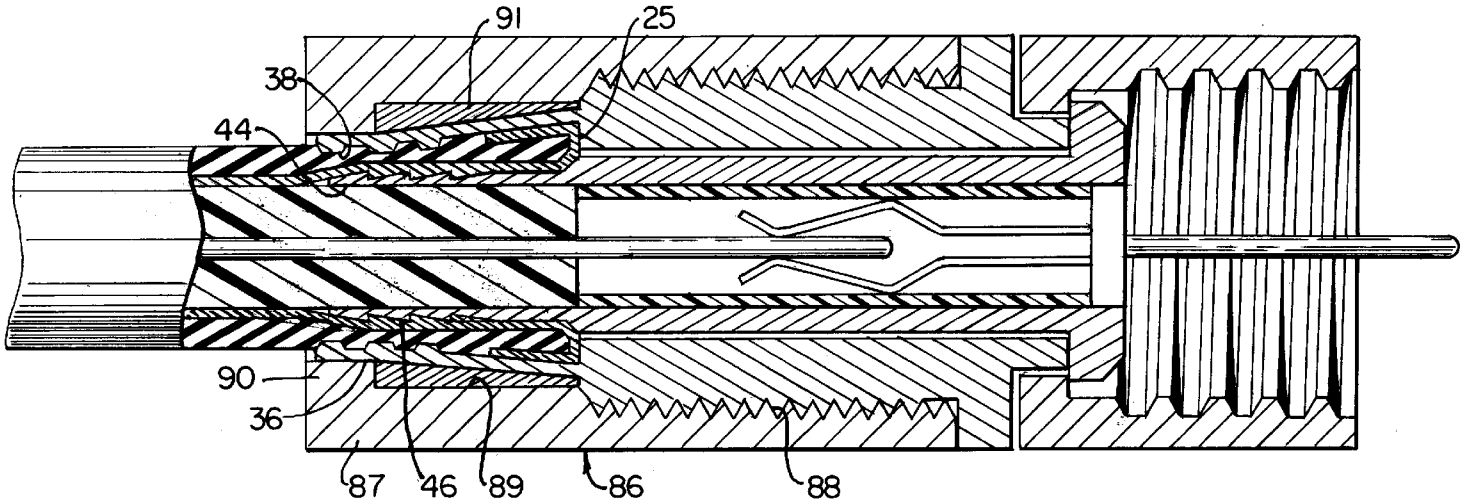
FIG. 5 is a cross-sectional view of an end connector fitting as illustrated in FIG. 4 with another preferred form of crimping device having a tubular insert therein to effect crimping.
Figure 6:
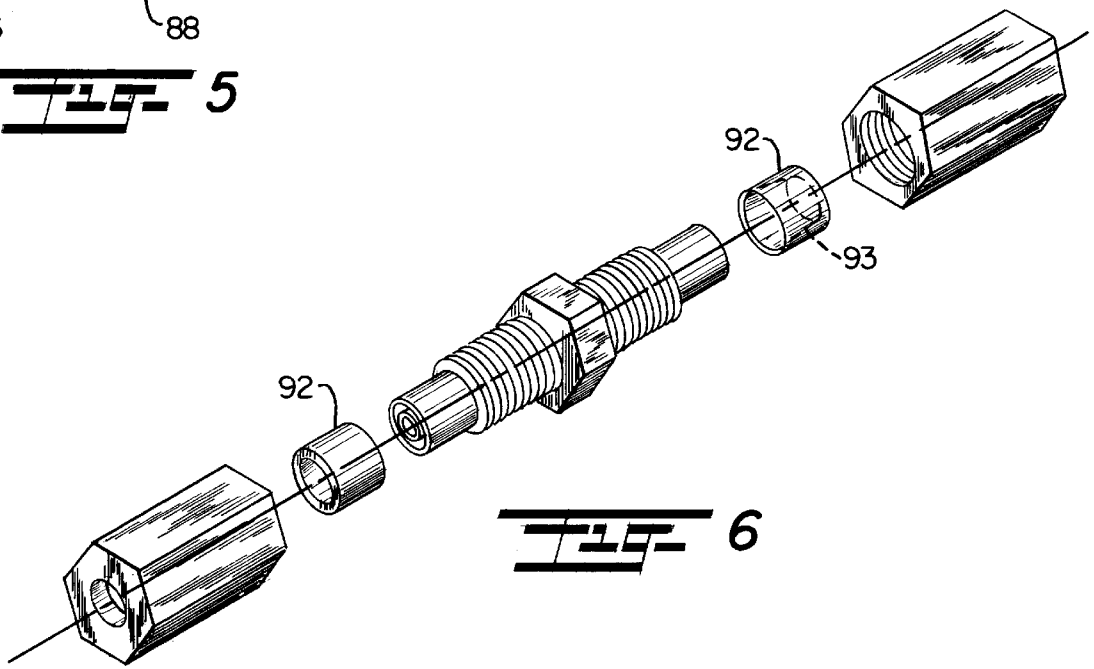
FIG. 6 is an exploded view of a pair of crimping devices of the type shown in FIG. 5.
Figure 7:
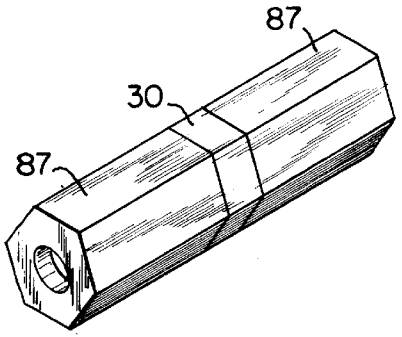
FIG. 7 is a somewhat perspective view of the form of invention shown in FIGS. 5 and 6 in fully assembled form.

In another preferred form of invention illustrated in FIGS. 5 to 7, like parts are correspondingly enumerated to those of FIG. 4 and wherein a crimping device 86 is modified by having a hollow, generally cylindrical nut 87 of substantially uniform wall thickness along its internally threaded portion 88 and a slightly thicker smooth wall surface portion 89 behind the threaded portion 88 terminating in an end wall 90 of reduced diameter. The non-threaded surface portion 89 behind the threaded portion is of a length less than the length of the sleeve portion 36 of the fitting, and a tubular insert 91 is of a length corresponding to that of the non-threaded surface portion 89 and dimensioned for loose-fitting insertion into the crimping device so as to rest against the end wall 90. The tubular insert 91 has an outer straight cylindrical surface portion 92 and an inner tapered die portion 93, the taper corresponding to that described with respect to the unitary tapered die surface portion 54 along the crimping surface of the crimping device 18 shown in FIGS. 1 to 3. Both the non-threaded surface portion 89 and the external surface portion 92 of the tubular insert 91 are highly polished or coated with a low friction material so that the threaded portion 88 will rotate independently of the tubular insert 91 while forcing the tubular insert 91 to advance axially along the outer sleeve portion 36 to radially contract the sleeve portion 36 as previously described.

It will be apparent that a hexagonal crimp may be achieved in a similar manner by making the insert 91 of a hexagonal configuration and journaled with respect to the threaded portion 88 so that the threaded portion 88 will rotate independently of the insert 91 while forcing it to advance axially along the outer sleeve 36. Again, however, a circular crimp will achieve more uniform reduction in diameter and sealing engagement between the sleeve 36 and jacket 25. Further, it will be evident that the mounting and disposition of the connecting ends 14 and specifically the inner and outer sleeves 44 and 36, respectively, may be varied with respect to the body portion 12 and, for example, may be A constructed in the manner described in hereinbefore referred to U.S. Pat. No. 5,501,616. Similarly, in a manner described in U.S. Pat. No. 5,501,616, the axially spaced rings 38 as well as the serrations 46 may be varied in dimension to accommodate different sized cables.

DETAILED DESCRIPTION OF MODIFIED FORM OF INVENTION

There is illustrated in FIG. 4 a modified form of end connector fitting 10' which is specifically adaptable for connecting an electrically conductive member, such as, an end of a coaxial cable, again designated at C1, into a post or terminal not shown, such as for example, on a standard television set. Like parts of the coaxial cables Cl are correspondingly enumerated to those of FIGS. 1 and 2, and a splicing device 18' corresponds to the splicing devices 18 as illustrated and described with respect to FIGS. 1 and 2. The end connector fitting 10', per se, corresponds to that disclosed in U.S. Pat. No. 5,501,616, being broadly comprised of a hollow cylindrical connector body 60 provided with an outer sleeve 62 at one end and an external shoulder 64 at the opposite end. However, the connector body is modified from that of my hereinbefore referred to U.S. Pat. No. 5,501,616 by being somewhat more elongated and provided with external threading 66 between the shoulder 64 and sleeve 62, the threaded portion 66 mating with the internally threaded portion 50' on the splicing device 18'. An inner sleeve 68 includes a sleeve body 69, an external shoulder or flange 70 at its forward end and a rearward extension 71 of reduced diameter and wall thickness in relation to the body 69, the extension 71 being substantially coextensive with the outer sleeve 62. An adaptor 74 has a radially inwardly directed flange 76 at one end which is interposed between the external shoulder 70 of the inner sleeve 68 and external shoulder 64 of the end connector 60. The adaptor 74 is internally threaded as at 78 and, although not shown, the external surface of the adaptor may be provided with flats to facilitate engagement by a hand wrench or other tool in threading the adaptor onto an externally threaded terminal or post.

Typically, a television post or terminal includes a socket which is adapted to receive a conductor pin, such as, the pin 80 which projects from a single prong connector 82 which is mounted within the inner sleeve 68 and provided with inwardly bowed ends 83 to receive the conductor pin 22 of the cable C1. A dielectric liner 84 is disposed within the sleeve 68 to insulate the sleeve 68 from the electrically conductive contacts 83.

The fitting 10' is crimped onto the end of the coaxial cable C1 by the splicing device 18' in a manner corresponding to that described with reference to FIGS. 1 to 4 and therefore will not be described in detail. Typically, however, the splicing device 18' will be threaded onto the connector body 60 to force the tapered die portion 54' and reduced portion 55' into crimping engagement with the sleeve 62 and effect a secure mechanical engagement with the cable C1 prior to assembly onto the post or terminal. For this reason, it is desirable that the adaptor 74 be journaled or independently rotatable with respect to the rest of the fitting 10 in threading onto the post until the external flange 70 of the inner sleeve is wedged between the post and the end of the connector body 60.

From the foregoing description of preferred and modified forms of invention, it will be evident that the outer sleeve to be crimped must be of a malleable material which is capable of undergoing inward radial contraction under the force of the splicing device 18 or 18' and yet be of sufficient strength as to maintain firm, sealed engagement with the coaxial cable. One suitable composition is a brass material and in the preferred form the entire connector body may be composed of brass. Similarly, the splicing device(s) 18 or 18' may be composed of a brass material and, being much thicker, will not yield as it presses the outer sleeve 36 or 62 into crimped engagement with the cable. Of course, retention of the splicing device(s) on the fitting 10 or 10' will reinforce the outer sleeve to maintain the sleeve 36 or 62 in crimped and sealed engagement with the cable. In applications where it may be desirable to remove the splicing device(s) 18 or 18' after crimping, the wall of the splicing device or nut may be longitudinally split or formed with a gap so that it may be separated away from the connecting end and removed.

It is therefore to be understood that the above and other modifications and changes may be readily made in the construction and arrangement of elements comprising the preferred and modified forms of invention without departing from the spirit and scope of the invention as defined by the appended claims and reasonable equivalents thereof.

I claim:

1. A fitting for connecting a cable having an electrically conductive member to another electrically conductive member, said fitting comprising:

a sleeve member of a thin-walled, continuous cylindrical configuration sized for insertion of an end of said cable therethrough; and a cylindrical crimping member having an inner tapered annular surface portion extending radially outwardly of said cylindrical sleeve member, and means engageable with said crimping member for advancing said crimping member axially with respect to said sleeve member whereby said tapered annular surface portion imparts inward radial deformation to crimp said sleeve member into sealed engagement with an external surface portion of said cable.

2. A fitting according to claim 1, wherein said tapered annular surface portion is of generally conical configuration.

3. A fitting according to claim 1, wherein said tapered annular surface portion is of an axial length less than the axial length of said sleeve member and includes a reduced diameter, straight cylindrical section at one end.

4. A fitting according to claim 1, wherein said fitting has a pair of said sleeve members at opposite ends thereof and a pair of said crimping members at opposite ends thereof.

5. A fitting according to claim 1, wherein said tapered annular surface portion has a first diameter at one end substantially corresponding to an outer diameter of said sleeve member and a second diameter axially spaced from said first diameter substantially corresponding to an outer diameter of said cable.

6. A fitting according to claim 5, wherein said tapered annular surface portion terminates at a reduced end in a cylindrical surface portion.

7. A fitting according to claim 1, wherein said advancing means is internally threaded and engageable with a complementary threaded portion on said sleeve member so that threaded advancement of said crimping member with respect to said complementary threaded portion causes axial advancement of said tapered annular surface portion along said sleeve member to radially contract said sleeve member into a tapered configuration in sealed engagement with said cable.

8. A fitting according to claim 7, wherein said complementary threaded portion defines an axial extension of said sleeve member.

9. An end connector fitting for connecting a cable having an inner electrically conductive member to another electrically conductive member, said fitting comprising:

radially inner and outer spaced concentric sleeve members defining an annular space therebetween for insertion of said inner electrically conductive member through said inner of said sleeve members, said sleeve members each being of continuous cylindrical configuration; and a crimping nut member having a tubular insert provided with an inner tapered surface portion, and means for advancing said nut member axially with respect to said sleeve members whereby said insert imparts inward radial deformation to crimp said outer sleeve member into sealed engagement with an external portion of said cable which is inserted into said annular space against an external surface of said inner sleeve member.

10. A fitting according to claim 9, wherein said tapered annular surface portion is of generally conical configuration.

11. A fitting according to claim 9, wherein said tapered annular surface portion has a first diameter at one end substantially corresponding to an outer diameter of said outer sleeve member and a second diameter at an opposite end less than said outer diameter of said outer sleeve member.

12. A fitting according to claim 9, wherein said advancing means is internally threaded and engageable with a complementary threaded portion on an axial extension of said sleeve members so that threaded advancement of said nut member with respect to said complementary threaded portion causes advancement of said tapered annular surface portion along said sleeve members.

13. A fitting according to claim 9, wherein said tapered annular surface portion is of an axial length less than the axial length of said outer sleeve member and terminates in a generally cylindrical end surface.

14. A fitting according to claim 9, wherein said fitting has a pair of said radially inner and outer spaced concentric sleeve members at opposite ends thereof and a pair of said crimping nut members at opposite ends thereof.

15. An end connector fitting for coaxial cables of the type having radially inner and outer spaced conductors wherein said fitting includes a hollow cylindrical connector body and radially inner and outer spaced concentric sleeve members having an annular space therebetween at least at one end of said body, said sleeve members sized for insertion of an end of said inner conductor therethrough, and insertion of said outer conductor into said annular space, said sleeve members each being of continuous cylindrical configuration, the combination therewith comprising:

a crimping nut member having an inner tapered surface portion at one end and an internally threaded portion at an opposite end for engagement with a complementary externally threaded portion on said connector body and wherein threaded advancement of said nut member axially with respect to said connector body will cause said tapered annular surface portion to impart inward radial deformation to crimp said outer sleeve member into sealed engagement with said outer conductor of said coaxial cable.

16. A fitting according to claim 15, wherein said tapered annular surface portion has a first diameter at one end substantially corresponding to an outer diameter of said outer sleeve member and a second diameter at an opposite end substantially corresponding to an outer diameter of said cable and said opposite end terminating in a generally cylindrical surface portion which will undergo uniform circumferential engagement with an external surface portion of said outer sleeve member whereby to crimp said outer sleeve member into sealed engagement with said cable when said nut member is threaded onto said body.

17. A fitting according to claim 15, wherein said fitting has a pair of said radially inner and outer spaced concentric sleeve members at opposite ends and a pair of said crimping nut members at opposite ends threaded onto externally threaded portions of said connector body, said connector body including an external shoulder interposed between said external threaded portions.

18. A fitting according to claim 15 wherein said crimping nut member includes a tubular insert provided with said inner tapered surface portion, said tubular insert being loosely inserted into said nut member to undergo axial advancement along said sleeve members in response to threaded advancement of said nut member axially with respect to said connector body.

19. A fitting according to claim 18 wherein said nut member includes a smooth cylindrical wall surface and a reduced end wall at one end opposite to said internally threaded portion against which said tubular insert is positioned when said nut member is threadedly advanced along said connector body.

* * * * *